United States Patent [19]

Hughes

[11] 4,202,073

[45] May 13, 1980

[54] MOISTURE STRIPPING DEVICE FOR FILM CLEANING APPARATUS

[75] Inventor: Richard J. Hughes, Mt. Prospect, Ill.

[73] Assignee: Research Technology Inc., Lincolnwood, Ill.

[21] Appl. No.: 927,751

[22] Filed: Jul. 25, 1978

[51] Int. Cl.[2] ..... B08B 5/02

[52] U.S. Cl. ..... 15/306 A; 15/316 R

[58] Field of Search ..... 15/306 A, 306 R, 316 R

[56] References Cited

U.S. PATENT DOCUMENTS

| | | | |
|---|---|---|---|
| 3,040,361 | 6/1962 | Baumbach | 15/306 A X |
| 3,750,229 | 8/1973 | Rossomme | 15/306 A X |
| 3,778,862 | 12/1973 | Kesler, Jr. | 15/306 A |

*Primary Examiner*—Christopher K. Moore

*Attorney, Agent, or Firm*—Hill, Van Santen, Steadman, Chiara & Simpson

[57] ABSTRACT

A moisture stripping device for non-evaporatively stripping moisture from a moving film such as a photographic motion picture film. The film is cleaned in a liquid bath which has ultrasonic energy applied thereto. The film leaves the bath and passes through an air nozzle which is supplied with a source of air pressure. The air nozzle consists of a split block having a film slot extending through the block. A plurality of air jets are conducted into the slot at opposite sides thereof. The film, wet with cleaning solution, enters the slot and is non-evaporatively dried by air pressure which forms a moisture barrier at the lower edge of the slot. The slot is only slightly wider than the thickness of the film, yet the film is protected from touching the sides of the slot by an air cushion formed by air jets directed at both sides of the film. The air jets are formed by a plurality of air holes in the split block. The holes conduct air from the air source to the film slot. A relatively large pressure drop is provided across the air holes wth the result that a uniform pressure is developed across the entire face of the film, preventing it from contacting the surface of the split block. The slot has sharp edges at the lower side which receives film to maximize the moisture barrier effect.

11 Claims, 3 Drawing Figures

MOISTURE STRIPPING DEVICE FOR FILM CLEANING APPARATUS

BACKGROUND OF THE INVENTION

1. Description of the Prior Art

Prior art methods of drying film strips utilize high volume air flow to strip the solvent from the film in the form of a fine spray. While such methods may have been referred to as "non-evaporative" drying, such is actually a matter of degree and the creation of mists in such processes tend to develop considerable vaporization. Such systems use high pressure, high volume air flow directed at oblique angles to the surface of the film to literally blow off the cleaning solvent. U.S. Pat. No. 2,967,119, FIG. 4, shows such a system in which high pressure air tears the cleaning solvent from the film surface and creates a spray. Baffling vanes are used to shield the film from the spray.

While being a very desirable system, the above dryer uses a high volume, high pressure air system and creates a spray of solvent. The present invention is a low pressure, low air volume and is a highly efficient air nozzle which truly non-evaporatively removes the solvent from the film surface without a spraying effect.

2. Field of the Invention

The field of art to which this invention pertains is dryers for film cleaning machines and in particular to dryers using air pressure as a means for stripping cleaning solvent from the surface of the film.

SUMMARY OF THE INVENTION

It is an important feature of the present invention to provide an air nozzle for non-evaporatively stripping cleaning solvent from the surface of a travelling film such as a photographic motion picture film in a film cleaning apparatus.

It is a feature of the present invention to provide a moisture removal device for a film cleaning apparatus which utilizes low volume air flow and low pressures to non-evaporatively strip cleaning solvent from the surface of a travelling film.

It is a principal object of the present invention to provide an improved device for film cleaning apparatus in which a novel air nozzle is used to strip cleaning fluid from the surface of a travelling film.

It is another object of the present invention to provide an air nozzle in a system described above wherein the nozzle has two planar surfaces immediately adjacent both sides of the travelling film and where air pressure is applied from the planar surfaces to both sides of the film to cushion the film against contact with the nozzle and to non-evaporatively strip the cleaning solvent from the film by providing a moisture barrier adjacent the entry region of the film into the air nozzle.

It is also an object of the invention to provide an air nozzle as described above wherein the planar surfaces define a slot which has a width which is slightly larger than the thickness of the film.

It is a further object of the invention to provide an air nozzle as described above where the nozzle is formed of a split block with the slot being formed by recesses surfaces in each half of the split block and wherein the region of entry of the film into the slot is characterized by sharp edges to create a moisture barrier as the film travels into and through the slot.

These and other objects, features and advantages of the present invention will be understood in greater detail from the associated drawings wherein reference numerals are utilized to designate a preferred embodiment.

DESCRIPTION OF THE PREFERRED EMBODIMENT

The moisture stripping air nozzle of the present invention is useable in a film cleaning apparatus in which darkened or soiled photographic motion picture film is unreeled at a high speed through a cleaning solvent, dried and then wound on a take-up reel. A cleaning solvent is energized by ultrasonic devices which loosen the dirt from the surface of the film and washes it into the solvent. The next step in the process is drying, where most vapors tend to be created. It is at this point that the solvent which adheres to the film by surface tension is removed from the film.

Heat drying mechanisms vaporize the greatest amount of solvent resulting in the greatest amount of waste. Other types of devices utilize high speed air to overcome the surface tension of the liquid and literally tear the liquid from the film. Such systems are shown in U.S. Pat. No. 2,967,119 and tend to generate a spray as the liquid is being torn from the surface of the film. This spray results from the use of high pressure and high volume air. Much less evaporation occurs in this system; however, there is still associated evaporation due to the spray effect of the solvent and the high air volume exposed to that spray.

The present invention utilizes an air nozzle which creates a moisture barrier at the region of entry of a photographic film into a slot formed in the nozzle. This moisture barrier removes cleaning solvent from the film. Essentially, the air nozzle consists of a block containing a film slot which is only slightly wider than the thickness of the film. Air jets are directed into the slot from both sides thereof and when the film is positioned in the slot the air jets are directed toward opposite sides of the film. These air jets provide a cushion of air for both surfaces of the film and allow the film to be moved at high speeds without touching either side of the slot. This cushion is uniform across the surface of the film due to the provision for a relatively large air pressure drop across air holes which develop the air jets. The air exits from both ends of the slot and the lower extremity thereof has sharp edges which cause the outrushing air to create a moisture barrier on the film slightly below the region of entry of the film into the slot.

Figure 1:
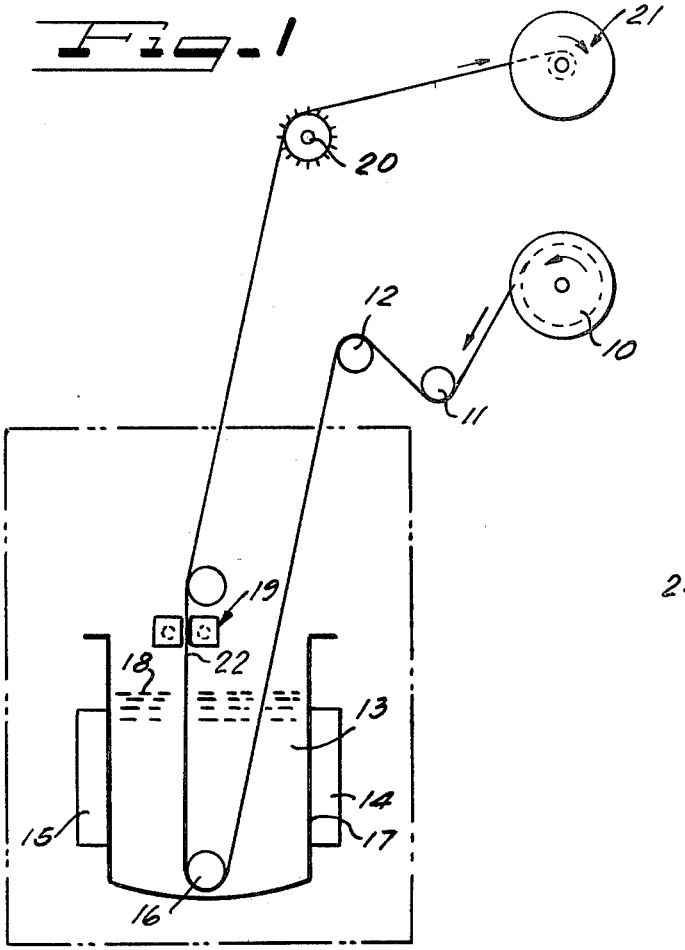
FIG. 1 is a diagrammatic illustration of a film cleaning apparatus according to the present invention.
Figure 2:
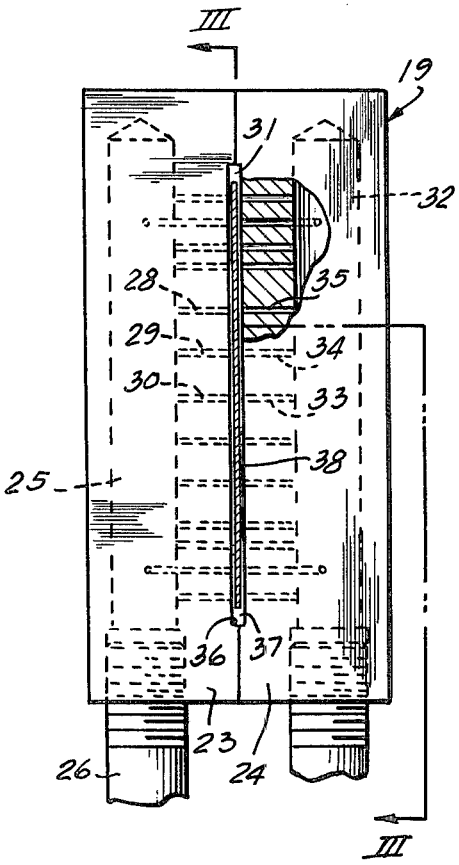
FIG. 2 is an enlarged view of a split block air nozzle according to the present invention and showing the film slot and the air pressure openings which conduct air pressure to both sides of the film.
Figure 3:
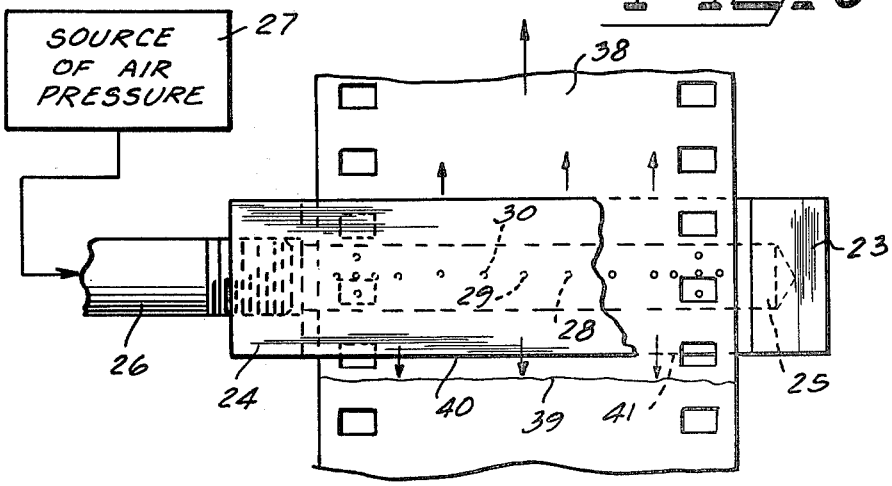
FIG. 3 is a sectioned view of the air nozzle of FIG. 2 taken along the lines III—III.

Referring to the drawings in greater detail, FIG. 1 shows a diagrammatical view of the basic elements of a moisture stripping apparatus of the present invention. In that figure, a supply reel 10 contains a soiled film to be cleaned. The film is unreeled over sprocket wheels 11 and 12 and enters a cleaning solvent 13 which is contained within a tank 17. The solvent is energized by ultrasonic devices 14 and 15, and a sprocket wheel 16 keeps the film near the bottom of the tank 17. The film leaves the solvent at a point 18 and passes directly to a moisture stripping device 19 for removing cleaning solvent adhered to the film by surface tension. From the device 19, film passes to a further sprocket wheel 20 and finally to a take-up reel 21. The cleaning solvent is stripped from the film at a point 22 which is immediately below the region of entry of the film into the moisture stripping device 19. The moisture stripping device 19 is shown in greater detail in FIG. 2 and is essentially an air nozzle which is formed by the mating of a pair of split blocks 23 and 24. The block 23 has an air distribution path 25 which is connected to an air line 26. The line 26 is in turn connected to a source of air pressure 27 as shown in FIG. 3. The distribution path 25 is coupled to a plurality of air jets such as 28, 29 and 30 which are directed toward a slot 31 at the abutting sides of the blocks 23 and 24. Likewise, the block 24 has a distribution path 32 coupling to a plurality of air jets 33, 34 and 35 which direct air into the slot 31.

The slot 31 is formed by a recess 36 of block 23 and a like recess 37 of block 24. Each recess in the preferred embodiment has a depth of about 0.005" making the slot width 0.010". Thickness of a film 38 which is positioned within the slot is approximately 0.0065". Accordingly, there is very little space between the sides of the film and the adjacent sides of the recesses 36 and 37. As the film is moved through the slot, it is important that it not touch the surface of the blocks for this would scratch or seriously damage the film. This close tolerance between film and slot is made possible by an air cushion on both sides of the film between the film and the sides of the slot. This air cushion is made uniform across the surface of the film 28 by maintaining a relatively large pressure drop across the air holes or jets 28, 29 and 30. In this way, a uniform pressure head is maintained in the air distribution path 25 resulting in uniform pressure at the outlet side of the air jets 28, 29 and 30. It is this uniform pressure that keeps the film from touching the surface of the blocks.

The air escapes at both ends of the slot, however, at the lower edge of the block, a moisture barrier is formed which prevents the cleaning solvent from entering the slot. The solvent which is carried on the surface of the film by its surface tension is literally peeled from the surface of the film at a region 39 immediately below the bottom edge 40 of the air nozzle. The lower edge of the slot such as at 41 is kept very sharp. It has been found that this sharp edge improves the moisture barrier 39. The width of the slot may vary depending upon air pressure and thickness of film, however, the advantages of this invention are achievable in a device such as shown in FIGS. 2 and 3 with a slot spacing of 0.010" and an air pressure as low as 20 psi. Therefore, this moisture barrier is developed at very low pressures and very low rates of air flow and creates the stripping of solvent with minimum evaporation.

It will be apparent that various modifications of this invention may be made, by persons skilled in this art, but all such modifications are intended to come within the scope of my invention as set forth in the attached claims.

I claim:

1. A moisture stripping device for non-evaporatively stripping moisture from a moving film comprising:

a moisture stripper head having first and second planar surfaces facing each other and spaced apart by the order of magnitude of the thickness of a film to be stripped of moisture and forming a film slot therebetween, said head, in the vicinity of each of said respective planar surfaces having a number of pressurized air openings for expelling pressurized air within the slot in a direction substantially normal to said respective planar surfaces, said pressurized air openings being connected to a main pressure line which in turn is fed from a source of pressurized air, means for positioning a travelling film within said film slot such that pressurized air from said air openings is generally directed against both surfaces of said film, said film having a liquid coated thereon prior to entering the vicinity of said film slot, and the pressure of air passing through said pressurized air openings substantially normal to the surfaces of said film being established at a level that provides a moisture barrier at the region of entry of the film into the film slot, whereby the air pressure at the region of entry of the film into said slot effectively non-evaporatively strips moisture from the surface of the film and substantially minimizes formation of a mist of removed moisture.

2. A moisture stripping device in accordance with claim 1 wherein said planar surfaces of said moisture stripper head are spaced apart by a distance not greater than a multiple of ten times the thickness of the film.

3. A moisture stripping device in accordance with claim 1 wherein said planar surfaces of said moisture stripper head are spaced apart by a distance which lies in the range between 0.007" and 0.050".

4. A moisture stripping device in accordance with claim 1 wherein said planar surfaces of said moisture stripper head are spaced apart by a distance which lies in the range between 0.007" and 0.020".

5. A moisture stripping device in accordance with claim 1 wherein said planar surfaces of said moisture stripper head are spaced apart by approximately 0.010".

6. A moisture stripping device in accordance with claim 1 wherein said moisture stripper head has first and second separable head sections, the first head section bears the first planar surface and the second head section bears the second planar surface, said first and second head sections being readily movable away from each other to a non-operative, open position to allow a film to be positioned therebetween and being readily movable toward each other to an operative, closed position to allow the film to be non-evaporatively stripped of its moisture as it travels through said film slot.

7. A moisture stripping device in accordance with claim 6 wherein each of said first and second head sections has a recessed region which bears one of said respective planar surfaces, each of said recessed regions forming one side of said film slot, said film slot being formed by abutting said first and second head sections together in the region of said recesses.

8. A moisture stripping device for non-evaporatively stripping moisture from a moving film comprising:

a source of air pressure, an air nozzle connected to the air pressure source, said air nozzle having a narrow slot through which a film may be moved at relatively high speeds, means directing air substantially normal to both surfaces of the film as it travels through the slot, and the faces of the slot at opposite sides of the film being sufficiently closely positioned to the film as to form a moisture barrier at the region of the film's entry into the slot, whereby moisture normally adhering to the surfaces of the film is forcibly removed therefrom by pressurized air exiting the slot at the region of entry of the film.

9. A moisture stripping device in accordance with claim 8 wherein said air nozzle has sharply defined edges forming the edges of the slot at the region of entry of the film.

10. A moisture stripping device in accordance with claim 8 wherein a plurality of air jets are directed normal to each side of the film to form an air cushion and allow high speed movement of the film through the slot without the film touching the edges thereof.

11. A moisture stripping device in accordance with claim 10 wherein the width of said slot lies in the range between 0.007" and 0.050".

* * * * *